US006228216B1

(12) United States Patent
Lindsay et al.

(10) Patent No.: US 6,228,216 B1
(45) Date of Patent: May 8, 2001

(54) TRANSFER OF A CELLULOSIC WEB BETWEEN SPACED APART TRANSPORT MEANS USING A MOVING AIR AS A SUPPORT

(75) Inventors: Jeffrey D. Lindsay, Appleton; Richard J. Kamps, Wrightstown, both of WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/113,772

(22) Filed: Jul. 10, 1998

(51) Int. Cl.[7] ..... D21F 11/00

(52) U.S. Cl. ..... 162/111; 162/204; 162/275; 162/280; 162/358.3; 162/361; 34/117; 34/114; 226/97.3

(58) Field of Search ..... 162/193, 204, 162/205, 306, 307, 358.3, 361, 363, 111, 109, 280, 265; 34/114, 115, 117, 120, 122; 226/57.3

(56) References Cited

U.S. PATENT DOCUMENTS

| | | | | |
|---|---|---|---|---|
| 3,309,263 | * | 3/1967 | Grobe | 162/306 |
| 3,861,996 | * | 1/1975 | Dorfel | 162/274 |
| 4,225,384 | * | 9/1980 | Valkama | 162/199 |
| 5,609,728 | * | 3/1997 | Durden | 162/205 |

* cited by examiner

*Primary Examiner*—Stanley S. Silverman
*Assistant Examiner*—Jose A. Fortuna
(74) *Attorney, Agent, or Firm*—Gregory E. Croft

(57) ABSTRACT

A gas stream directed at a velocity against a cellulosic web in a papermaking machine can act to transfer the web from a transport web moving at a first speed to a transport web moving at a second slower speed. The transport webs apply a linear velocity to each to the cellulosic web on the transport web. The gas stream in the form of an air knife can be directed through the first fabric against the web and can transfer the web from the first fabric to the second fabric. The difference in velocity between the first transport web and the second, increases bulk, introduces a surface finish or otherwise modifies the character of the cellulosic web.

34 Claims, 3 Drawing Sheets

TRANSFER OF A CELLULOSIC WEB BETWEEN SPACED APART TRANSPORT MEANS USING A MOVING AIR AS A SUPPORT

FIELD OF THE INVENTION

The invention relates to methods and apparatus for making paper in the form of a cellulosic web using a differential velocity transfer of the cellulosic web between spaced apart flexible, elastic transport means, such as felts, fabric, belts, meshes etc., driven by mechanical rolls or rollers. The differential velocity transfer, i.e., processing a cellulosic web on a higher speed transport means and transferring the cellulosic web to a lower speed transport means, improves properties of the transferred web. The invention involves apparatus and process steps used to transfer the web in a differential velocity transfer mode, between spaced apart paper making transport means, in an efficient manner. The invention additionally involves incorporating chemical additives into or onto the cellulosic web during the transfer.

BACKGROUND OF THE INVENTION

In the manufacture of paper products, typically paper or cellulosic webs having increased bulk, the initially formed web can be mechanically processed to introduce properties or features, such as greater ductility, more softness, more fluffiness, more absorbing power, changed texture or modified shape, to the web. Such properties can be introduced into the web by changing the speed or velocity of the paper during transfer between one production or transport means to another similar means. The change in velocity from high velocity to low velocity can cause the paper web to "buckle" or "backup" and can cause a significant change in properties. Such transfers are conventionally done in a surface to surface interface in an area of direct contact between the transport means moving surfaces. Typically, the longitudinal change in the rate of travel of the paper can involve transfer of the cellulosic web from a roller or from a fabric or felt to a similar surface in an area of contact between surfaces. In the area of contact between the surfaces the cellulosic web is modified by both frictional forces in the area of interface and by the velocity change.

Such processes are common in the art and have a degree of utility. However, such methods suffer from limitations including a narrow range of operating variables (change in velocity, web dimensions, etc.) and frictional problems arising at the interface between transfer means in contact. A substantial need in the art has arisen for processes that provide greater flexibility in paper processing in the this differential velocity transfer of a web from transport means to transport means to obtain greater flexibility in paper properties. A still further need exists for processes that can be used to effectively treat the web with chemical additives that can improve the physical properties of the cellulosic or paper web or improve the web processing characteristics.

One contact velocity transfer technology involves the use of an air blowing nozzle in conjunction with a suction zone to remove water in the initial stages of the formation of a high bulk, soft creping process. A particular paper forming process uses an apparatus disposed next to a wire or fabric opposite a paper web, to create a wave of positive air pressure urging the web off the wire in a typical Fourdrinier process. This process is conducted in the initial stages of paper manufacture while the web is still substantially wet in order to direct the web to finishing stages of the manufacturing process. Similar processes known in the art include an air stream and an air foil used in combination to move a newly formed wet web from a roll to a drier fabric or felt. Another known process involves a transfer mechanism for loosening the web from a papermaking screen using a stream of air continuously up into the Fourdrinier screen and against the paper web to loosen the web and facilitate its transfer from the screen to the felt.

Similar transfer processes include methods in which a newly formed web is transferred from a metal roller to a felt, and a doctor blade assembly which uses a cooperating air blast to doctor a paper web from a cylinder surface or to dry a paper sheet by passing the doctor between the web or cylinder using the passage of air. Another method known in the art is a roller to roller transfer, using rollers at constant velocity, of a paper web using an air jet guide. A variation of this is a constant velocity belt to belt transfer of a web using a movable doctor blade/air blower that initiates a surface to surface transfer of a web between surfaces, the surfaces maintained in physical contact. The apparatus comprises a doctor blade that physically begins web removal and then promotes web removal and transfer at constant velocity between surfaces using an air blast. A process is known for introducing a controlled thickness into a web by compressing the web between rollers with a calibrated gap in which the process includes an air jet that promotes removal of the calibrated web from the constant velocity rollers interface.

Paper making is a mature industry in which a variety of process steps have been used to obtain a variety of paper properties and to improve processing conditions. Another technology uses a steam driven coating process in which a steam stream transfers a chemical additive into a paper coating layer. A liquid coating process is known whereby a coating is applied by atomizing material with an air stream to coat a web. The process uses a thin line or stream of pressurized air to act as a doctor blade to maintain coating uniformity. Related art reveals the use of an air jet-like doctor blade to adjust a powder coating thickness and the use of a steam jet to introduce a silicone release additive onto a paper web.

BRIEF DISCUSSION OF THE INVENTION

An improved production method for cellulosic webs is disclosed offering a wide scope of improvement in operational parameters which inherently enhances the bulk, softness and other physical properties and processability of a cellulosic web. In the improved method obtained with differential velocity transfer processes, a non-contacting, non-compressing transfer process is utilized to transfer the web from a first transport surface to a second transport surface in a differential velocity transfer mode in which the surfaces are not in direct contact and are positioned at a spaced apart configuration. The surfaces are typically moving production or transport webs such as belts, fabric, elastic or other transport means, that move through a parallel, spaced apart transfer zone in which the cellulosic web is transferred from one production surface to another. The non-contacting web transfer process relies on a mobile gas stream, such as a stream of air (or, equivalently, any other mobile gas stream, such as nitrogen) used first to help remove the paper web from transport web to a second transport web using the gas stream as a guide and support during the transfer the cellulosic web between the transport means. The air stream supports and guides the web from a first fabric or felt to a second fabric or felt moving at a speed lower than the first or original fabric in a differential velocity transfer mode.

In one embodiment, the stream of air can be directed through the mesh fabric or felt using the air pressure to prompt the web from the higher velocity transfer web, mesh, fabric or felt. The air then promotes and supports transfer of the removed web to the second lower velocity surface. In a second mode, the air stream can be directed at the interface between the web and the transfer web, fabric or felt, on the web side of the felt or fabric, at the point of removal or separation of the web. The pressure of the air can promote the separation of the web and can act to promote the transfer of the web from the higher velocity surface to the lower velocity surface. For the purpose of this invention, the mobile gas stream or air stream uses the ambient atmosphere or commonly available atmospheric gases at ambient room or slightly elevated temperatures that can range from about 20° C. to 105° C. preferably 20° C. to 90° C., or somewhat higher. Preferably, high temperatures, i.e., air at or substantially greater than about 90° C. are not used in the invention. For the purpose of this invention, the mobile gas or air stream uses the ambient atmosphere or commonly available atmospheric gases at ambient room or slightly elevated temperatures that can range from about 20° C. to 85° C. preferably 20° C. to 50° C., typically 20° C. to 37° C. Typically, ambient air is used at ambient temperature using a conventional compressor or blower apparatus. One advantage of the use of the air stream is the capacity to entrain, into the air stream, one or more finely divided liquid or powdered chemical additive compositions that in or on the web can modify the paper physical properties or processability. Such chemicals can be introduced in a finely divided particle form, a finely divided liquid form in which the materials are dispersed or suspended in a liquid carrier such as an aqueous medium or aqueous/solvent or solvent based medium. Powdered chemicals tend to reside on the surface of the web while liquid solutions or dispersions can penetrate into the web.

BRIEF DISCUSSION OF THE DRAWINGS

FIG. 1 shows a differential velocity transfer using one embodiment of an air knife in which the air is directed through the flexible transfer web, fabric felt or elastic belt on the side of the transport web opposite the cellulosic web. The air stream acts to transfer the paper or cellulosic web from a movable transport means moving at a relatively higher speed to a second moving transfer means moving at a relatively slower rate.

FIG. 2 shows a second embodiment of the process of the invention in which the air stream is directed against the moving transport means on the cellulosic web side of the transport means and acts to promote separation of the paper or cellulosic web from the transfer means moving at a relatively higher speed. The cellulosic web is then supported by the air stream while moving to a second transfer means moving at a relatively lower speed.

DESCRIPTION OF THE PREFERRED EMBODIMENTS

Figure 1:
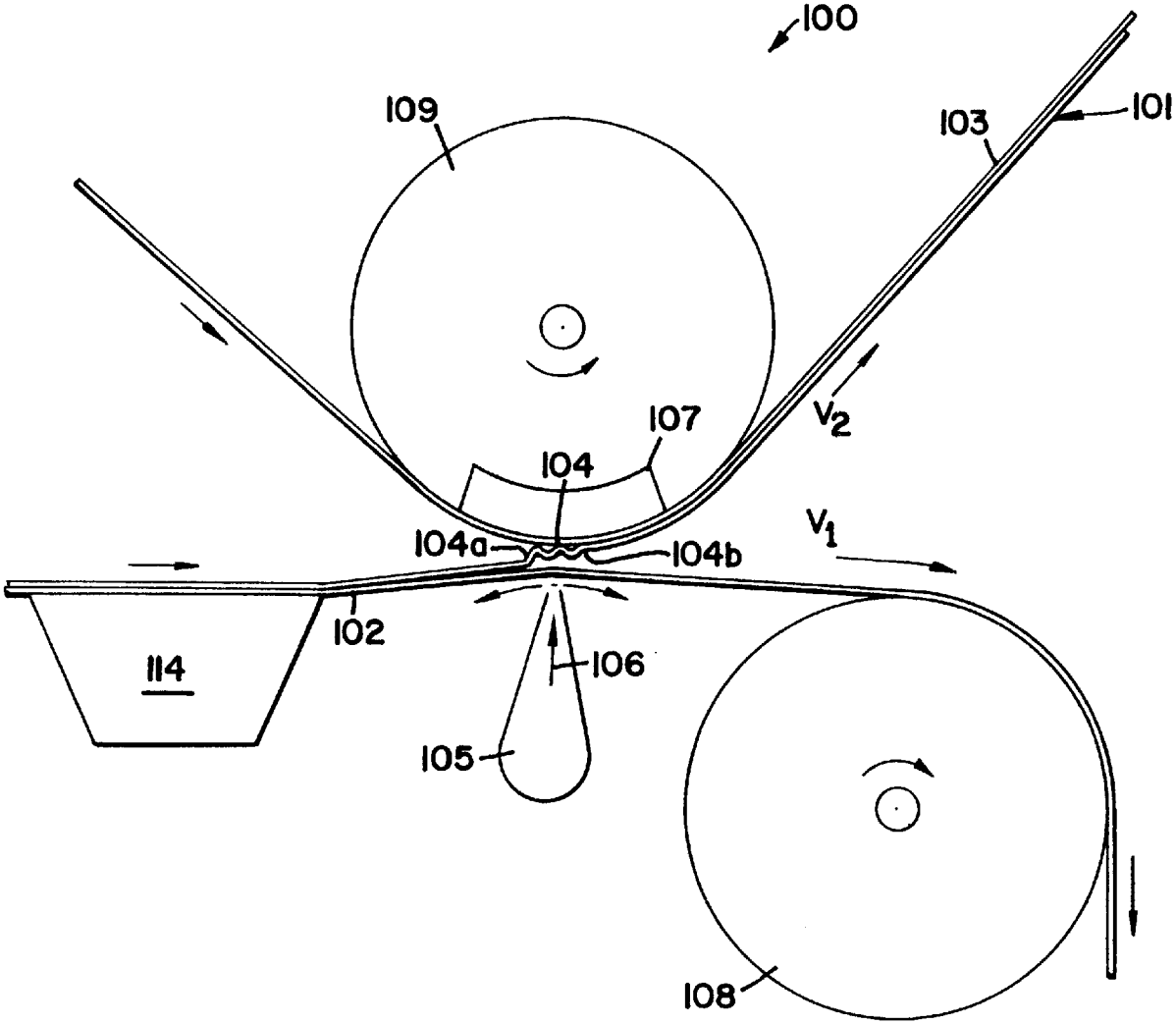

The process of the invention includes elements that can be incorporated into a conventional papermaking machine such as a Fourdrinier papermaking machine resulting in a complete system that converts an aqueous fiber dispersion into finished paper. The elements of the inventive process and apparatus are used with a cellulosic web after the web is initially formed from the aqueous fiber dispersion. The web can be single layer or can have two three or more stratified layers. In a typical papermaking machine, a head box, containing an aqueous dispersion of fibrous cellulosic material typically called a stock, deposits the stock onto the outer surface of the moving foraminous base conveyor of a Fourdrinier wire or dewatering surface. The conveyor has an outer surface which receives the stock and an inner surface which faces rolls and other machine elements that supports the wire upon which the paper layer is formed. The wire is provided with return rolls provided to maintain the wire at a suitable tension for smooth web formation. In the machine the wire and stock travel over a plurality of dewatering devices which draw liquid out of the stock and convert the stock into a continuous fibrous cellulosic web. The cellulosic web transfers from the wire at a transfer point and is received by a subsequent section of the machine. Dewatering is commonly accomplished using conventional table rolls, conventional suction boxes or vacuum boxes. The process and apparatus of the invention are used subsequent to the dewatering step forming the cellulosic web.

The papermaking webs of the invention can comprise any known cellulosic or papermaking fibers such as hardwood or softwood fibers. The fibers may be bleached or unbleached and can be produced with any known process such as kraft pulping, sulfite pulping, chemithermomechanical pulping, thermomechanical pulping, or the like. The fibers can be high yield or low yield. Natural cellulosic fibers such as cotton, kenaf, milkweed, and others can be used, as well as chemically modified or synthetically produced cellulosic fibers, including regenerated cellulose fibers. Desirably, the dry weight basis of the web is between 10 and 200 gsm (grams-$m^{-2}$) more specifically between about 15 and 60 gsm, and most specifically between about 15 and 40 gsm.

The web may be dried by any known process, and specifically can be a creped tissue dried on a Yankee dryer or can be a creped or uncreped through-dried tissue web. Examples of uncreped through-dried tissue webs include those taught by F. J. Chen et al. in commonly owned U.S. patent application Ser. No. 08/614,420, "Wet Resilient Webs and Disposable Articles Made Therewith;" U.S. Pat. No. 5,429,686, issued to Chiu et al. on Jul. 4, 1995; U.S. Pat. No. 5,399,412, issued to S. J. Sudall and S. A. Engel on Mar. 21, 1995; U.S. Pat. No. 5,672,248, issued to Wendt et al. in Sep. 30, 1997; and U.S. Pat. No. 5,607,551, issued to Farrington et al. on Mar. 4, 1997; all of which are herein incorporated by reference. In several embodiments it is desirable that drying be done by substantially non-compressive methods to preserve the bulk and porosity of the web. Normal Yankee drying, for example, is compressive, for the wet web is pressed against the Yankee cylinder to dry. Uncreped tissue making processes can use noncompressive drying methods advantageously.

The properties of the cellulosic web can be modified by a differential velocity transfer. In the differential velocity transfer, a transport web containing or supporting the cellulosic web conveys the cellulosic web to a transfer or transport zone. In the transport zone, the cellulosic web is removed from a first transport web and is then transferred, through a transfer zone, to a second, slower moving transport web spaced apart form the first. The transfer from the faster moving transport web to a slower moving transport web changes the properties of the cellulosic web. In the transport zone, the cellulosic web is transferred from the first transport web to the second transport web using an air blast to support the cellulosic web in the transfer from web to web. The air blast can also aid in urging the cellulosic web from the first transport web. When the cellulosic web comes in contact with the second transport web, the air blast can urge the cellulosic web onto the second transport web. Vacuum means associated with the second transport web can also aid in ensuring close contact between the cellulosic web and the second transport web. For the purpose of this patent application, the term "transport zone" connotes the area in which the first transport web and the second transport web come into a proximate, but non-contacting position. Typically in the transport zone, the transport webs are moving in a parallel, but spaced apart direction. The separation between the transport webs is greater than the thickness of the cellulosic web and specifically can be at least about 0.1 centimeters, specifically about 0.3 to about 15 cm, more specifically about 0.4 to about 5 cm, and most specifically about 1 to 3 cm. Differential velocity transport imparts in-plane microcompressions and a degree of foreshortening to a cellulosic web that generally increases the machine direction stretch of the web, which is particularly important if the web is an uncreped tissue since creping normally provides desirable stretch to a tissue web. Likewise, softness can be increased, flexibility can be improved, and bulk and absorbency of the web can also be increased by virtue of the foreshortening and fiber rearrangement of differential velocity transfer. The texture of the transport webs can also be used to modify the topography of the cellulosic web. If the second transport web is highly textured, for example, as are the fabrics of Chiu et al., previously incorporated by reference, then the differential velocity process can assist in molding the cellulosic web to the textured fabric for improved topography. If the second transport web is relatively smooth, on the other hand, as is a typical forming fabric or press felt, then the differential velocity transfer can serve to increase the internal bulk and porosity of the web due to foreshortening while maintaining smoothness of the web. In the transport zone, the air stream is positioned with respect to the transported cellulosic web at a location such that the air stream can promote removal of the web from the first transport means, support and guide the cellulosic web from the first transport means to the second transport means and then urge the cellulosic web onto the second transport means.

A first aspect of the invention comprises a differential transport apparatus that modifies the properties of the cellulosic web by transferring a cellulosic web from a first transport web to a second, slower moving, transport web, the cellulosic web being supported by an air blast.

A second aspect of the invention is a process and apparatus for using an air blast for transferring and supporting a cellulosic web between differential velocity transport webs in which the air blast has an entrained stream of a chemical additive.

With the foregoing statement of the invention and the aspects of the invention in mind, we provide a method of transferring a traveling web of cellulosic fibrous material which comprises moving said web from a transport web or porous carrier to an area on a second similar web positioned at a distance from the first porous carrier while maintaining the velocity of said second traveling web at a rate lower than the velocity of the first. The transfer between transport webs is facilitated by a moving air stream that is directed to support the traveling web between carriers. Such transport support is maintained by creating an air pressure differential between the pressure at the underside of the transport or traveling web in the top side of such web in the region between the spaced apart web surfaces.

The apparatus in the invention for treating the transport web of fibrous material comprises a porous transport or carrier web for conducting the web of fibrous material in the higher velocity carrier and a similar web for the lower viscosity carrier. The apparatus also comprises means for driving said porous carriers at different velocities. The invention includes a transfer region or zone between the first higher velocity porous transport web and the second lower velocity web. In this transport region between moving webs, the traveling web is supported by air pressure. The problem of optimizing process parameters and reducing surface to surface friction between carriers is solved by permitting a substantial separation between the porous carriers within which the traveling web is supported by a moving air stream. In this way, all the advantages of the differential velocity transfer between carrier webs is retained while avoiding the limitations on process conditions and surface to surface friction. The friction between wires in the web during transfer can result in wrinkles or macrofolds, as well as dislocated fibers and poor formation in the web. Additionally, an additional unique advantage of the use of air pressure to support the traveling web between carriers results from ability to entrain chemical additives into the air stream causing the additives to be incorporated into the web or onto the surface of the web for improving the physical properties of the web and the web processability.

The process for changing the physical structure of the traveling web is initiated by features that cause a deceleration of the web of fibrous material in the zone of transfer from the first transport web to the second web. The water content, adhesive character and chemical additives in the traveling web ensure that the traveling web is securely adhered to the second carrier web to ensure the paper product is smooth and unfolded without surface blemishes or wrinkles. The adherence of the traveling web to the second carrier web can be improved by any elasticity in the carrier web. The velocity of the second carrier web can be a fraction (k) of about 0.1 to about 0.98, preferably 0.2 to 0.8, of the velocity of the first carrier web to obtain satisfactory improvement in the physical parameters of the traveling cellulosic web.

The method of the invention can be applied to both moist or dry webs of fibrous materials. Under certain circumstances adequate results can be obtained with a moist web having a water content of between about 1 and 85 wt %. Preferably, the web has a water content of between 40 and 80 wt % and more preferably has a water content of about 50 to 75 wt %.

The dimension of separation between the transport webs at the closest separation point in the transport zone should not be and need not be great. As the distance between carrier webs increases, the difficulty of supporting the traveling web between carriers becomes increasingly more difficult. And as the distance between carrier webs is reduced, the webs come into such close contact that operating the system becomes more difficult and adding chemical to the traveling web becomes more difficult. In a preferred mode, the planes defining the surface of each of the carrier webs are parallel and are moving in the same direction in the transfer zone between webs where the traveling web is supported by the air pressure.

The range of velocities of the first carrier web commonly comprises about 3 to 40 meters per second, preferably 6 to 30 meters per second. The velocity of the second carrier web is a fraction of that speed and can be calculated by applying the fraction disclosed above, using formula I below, that relates the speed of the first web ($V_1$) to the speed of the second carrier web ($V_2$).

$$V_2=kV_1 \quad \text{I}$$

In the first carrier web apparatus, a suction pick-up device or vacuum device prior to the transfer point can be installed to remove water from the web before the web enters the differential velocity process.

In the differential velocity processing mode of the invention, the cellulosic web is transferred from one transport web to another transport web. These transport webs can comprise virtually any flexible movable belt-like material that can act as a support/transport web useful with cellulosic or paper webs. Such transport means can comprise wire mesh, fabric, felt, elastic belts, non-woven fabric, fabric mesh, etc. Such belts are mechanically strong enough to support the cellulosic web while maintaining contact with the drive mechanism such as a metal roller. Such belts form a closed loop but can have a length, in the loop, of about 10 to 150 meters, preferably 15 to 75 meters. The width of the transport means can range from about 20 to 1500 centimeters, preferably 50 to 800 centimeters. Depending on the nature of the material, the thicknesses can vary from about 0.1 to 1 centimeters, preferably about 0.2 to 0.9 centimeters. The material for the transport means can be any known in the art, including but not limited to nylon, polyester, other polyamides, polyolefins, or the like.

Adherence of the fibrous traveling web to the second transport web can be improved using a vacuum roll device. The vacuum roll reduces air pressure at the surface of the second slower moving traveling web causing the fibrous web to be drawn to and firmly attached to the moving belt. The bias created by the reduced pressure at the surface of the traveling web tends to cause the web to adhere to and remain in close association with the moving web after the web passes from the first to the second surface. The increased pressure of the air knife can cooperate with the reduced pressure at the surface of the second web to ensure a reliable transport.

Air pressure applied between the space between the carrier and transfer fabric can help support and move the web between the two transfer points. Any means to develop air pressure and the transfer interface can be used. One preferred mode is the use of an air knife device positioned in proximity to the traveling web between transport webs. The air knife device comprises a chamber surrounding a source of air that terminates an elongated orifice for directing the air stream into the stabilizing support stream of air supporting the traveling web. Typically, air knifes are provided with a source of ambient air under pressure which is directed out the elongated orifice in a continuing fashion to provide constant support for the traveling web during papermaking operations. Air pressure to the air knife can be provided using any conventional means developing air pressure delivered to the interior of the air knife structure. In the use of a preferred air knife of the invention, an air knife comprises means provided for forcibly delivering a thin sheet of air generally normal to the cellulosic web or tangential to a curved surface of the transport web. In either directions, the air blast can urge the cellulosic web from the transport web. The device that creates the air knife is typically a hollow shell or case having a narrow slot or passage at the apex of the apparatus. The air blast is directed from the narrow slot formed in the device. The air knife apparatus is preferably more or less triangular in cross-section. In this preferred mode, the narrow slot or air blast exit is positioned at the apex of the triangular cross-section. Within the apparatus, air under pressure is introduced. The pressure urges air out the slot or narrow passage in a defined direction.

In one mode of operation, a continuous stream of a chemical additive can be introduced into the air knife and directed against the traveling web of the invention. The additive can be in the form of a fine powder, or an atomized liquid comprising a chemical dissolved or dispersed in a liquid such as a solvent, an aqueous medium or an aqueous solvent medium. The powder, liquid additive solution or dispersion can be entrained into the air stream using conventional atomizing or dispersing apparatus. Dispersing apparatuses for powders, particulates, slurries, and liquid can also include injection ports or entry ports through which material is delivered by screw drives or screw pumps, peristaltic pumps, pistons, and the like; ports for delivery of particles entrained in gas from a fluidized bed or static bed of loose particles; chutes for gravitational feed of particles, slurries, or liquid; ultrasonic, mechanical impact, mechanical friction, or electric spark methods for abrading or removing dispersed matter from a solid source, or the like. Particulates can also be formed in the gas stream by chemical reaction of injected volatile or liquid components. Chemical additives that can be used to improve the properties or processability of the cellulosic web include both chemicals that are dispersed on the surface and throughout the web or coating materials that can form a substantially continuous coating on one or both surfaces of the web. Chemical additives can improve the sizing, dry strength, wet strength, optical properties, color and surface character of the web.

Chemical debonders and softening agents can be added to increase bulk or to provide a soft, lotiony feel. Quaternary ammonium compounds with fatty groups represent one class of softening agents, and many others are known in the art. Emollients, including silicone compounds, can also be added to improve surface feel and reduce friction against the skin. Natural compounds such as aloe vera extract, vitamin E oil, and other natural derivatives for skin care can be added. Baking soda, zeolites, talc, perfumes or the like can be added. Particles may be added in slurries with a liquid carrier such as water or as dispersed dry particles. Processing aids can also be used to improve the operation of the papernachine. Such processing aids include defoamers, wet web strength additives, pitch control agents, creping aids, antifungal agents, and other similar materials. Functional additives include sizing agents such as rosin based cellulose reactive materials, wax emulsions, flurochemicals. Dry strength additives include natural gum starches, cellulosics, polymeric materials. Wet strength additives include urea formaldehyde resins, melamine formaldehyde resins, epichlorohydrin resins. Fillers include mineral pigments including clays, carbonates, silicas, aluminas and talc. A variety of synthetic polymeric pigments have been used for fillers for paper. Functional surface treatments can be added to the surface of the paper in the papermaking machine. Commonly, surface sizings comprising starches and modified starches, oxidize starch, hydroxyethylated and cationic starches are used, and other sizing agents such as alkyl ketene dimers (AKD) or alkyl succinic anhydrides (ASA) can also be applied. Such materials improve surface strength and smoothness. Starches can be used with other surface sizing agents including rosins, emulsions, wax, wax rosin combinations, polymeric sizing agents and others. Fluorochemical emulsion sizing agents can be applied to provide oil and grease repellency. Creping aids can be applied to the surface of the paper by spraying an aqueous emulsion through the air knife material of the invention. Anticurling agents can introduce a curl control into the paper by application of controlled amounts of water to the surface of the paper. Lastly, pigmented coatings and binders can be applied.

Such materials can be added dry, i.e. as a stream of finely divided particulates against the fibrous web. Further, the materials can be added in the form of a atomized or finely divided droplets of an aqueous or solvent based solution or dispersion of the additive materials. The dry stream or the wet stream can be introduced into the air knife device of the invention using conventional atomizing agents, ultrasonic dispersing means and other conventional systems.

A dry powder stream can be introduced into the air knife apparatus of the invention by first creating a powder stream using ultrasonic means, or cyclonic fluidized bed apparatus. Such processing can introduce a powder stream initially into the air stream which can be moved into the air knife and then transferred to the cellulosic web. The air stream can contain about 0.1 to 100 grams per cubic meter, preferably 1 to 20 grams per cubic meter of the chemical additive in the air stream leaving the air knife apparatus. Alternately, the additive can be introduced into an aqueous, solvent based or mixed aqueous solvent medium. The concentration of the chemical additive in the liquid can be about 1 to 500 grams of additive per liter of solution or suspension, preferably about 10 to 300 grams of additive per liter of solution or suspension. Such liquid materials can be introduced into the air stream using a variety of means that can produce a finely divided aerosol or spray of the material. Such means include high pressure sprays, venturi based aerosol generating apparatus, ultrasonic aerosol generating apparatus and other known atomizing means. When a liquid solution or suspension of the chemical additive is used, the air stream leaving the air knife typically comprises about 1 to 100 grams of additive, preferably about 2 to 30 grams of additive per cubic meter of air. Application of chemicals to the surface of the tissue web can be especially desirable when the web structure itself is layered, as, for example, in a sheet having shorter fibers preferentially on an outer surface. Application of strength enhancers to layers of long fibers and softness enhancers to layers with short fibers is one useful strategy, for example. Layered sheets are well known in the art and can be produced by a variety of methods, including stratified headboxes and the couching of multiple sheets from multiple headboxes.

DETAILED DISCUSSION OF THE DRAWINGS

FIG. 1 shows a first embodiment of the non-contacting, non-compressive differential velocity transfer process using pressure from an air knife to transfer the cellulosic web 101 from a first transport web 102 to a second transport web 103. FIG. 1 generally shows apparatus 100 comprising transfer of a traveling cellulosic web 101 from a first porous web 102 to a second porous web 103. The velocity of motion of the first porous web 102 parallel to but is substantially greater than the velocity of the second web 103. The velocity of the webs are shown in $V_1$ and $V_2$. $V_2$ can be determined by multiplying $V_1$ by a factor k (as in $V_2=kV_1$). Such factor can range from about 0.1 to about 0.98 and specifically can be about 0.1 to 0.92, more specifically about 0.2 to about 0.9, and more specifically still about 0.4 to about 0.9, and most specifically about 0.5 to 0.85. The porous webs 102 and 103 move in a parallel fashion and are positioned in close proximity at a transfer region 104. The transfer region 104 is defined as the area between the location 104*a* on transfer web 102 at which the web leaves the first transport web 102 and the point 104*b* on transfer web 103 at which the web 101 becomes adhered to the second transport web 103. Within this transfer region 104, the properties of the cellulosic web 101 are changed by the differential velocity aspect of the transfer. The transfer of the cellulosic web from one surface to another is promoted using an air knife apparatus 105 which directs air knife stream 106 against the first porous web positioned substantially normal to the cellulosic web thus biasing the cellulosic web 101 from the first porous web 102 to the second web 103. An optional vacuum system 107 in contact with the second transport porous web 103 in the transfer region aids in biasing the cellulosic web from the first porous web 102 to the second porous web 103 in the area of reduced pressure resulting from the vacuum 107. The direction of the stream of air or air knife 106 from the air knife apparatus 105 can be varied in an arc-like manner as shown in FIG. 1. The movement of the air knife in the arc-like manner can aid in prompting the cellulosic web from the porous web, can aid in biasing the cellulosic web against the second surface and can also aid in forming a uniform add-on of chemical additives into the cellulosic web or can aid in forming a uniform coating of coating materials on the web. The moving porous transport web 102 is driven by roll 108. The moving porous transport web 103 is moved by roll 109.

The cellulosic web 101 can be dewatered by a vacuum box 114 prior to the differential velocity transfer processing.

Figure 2:
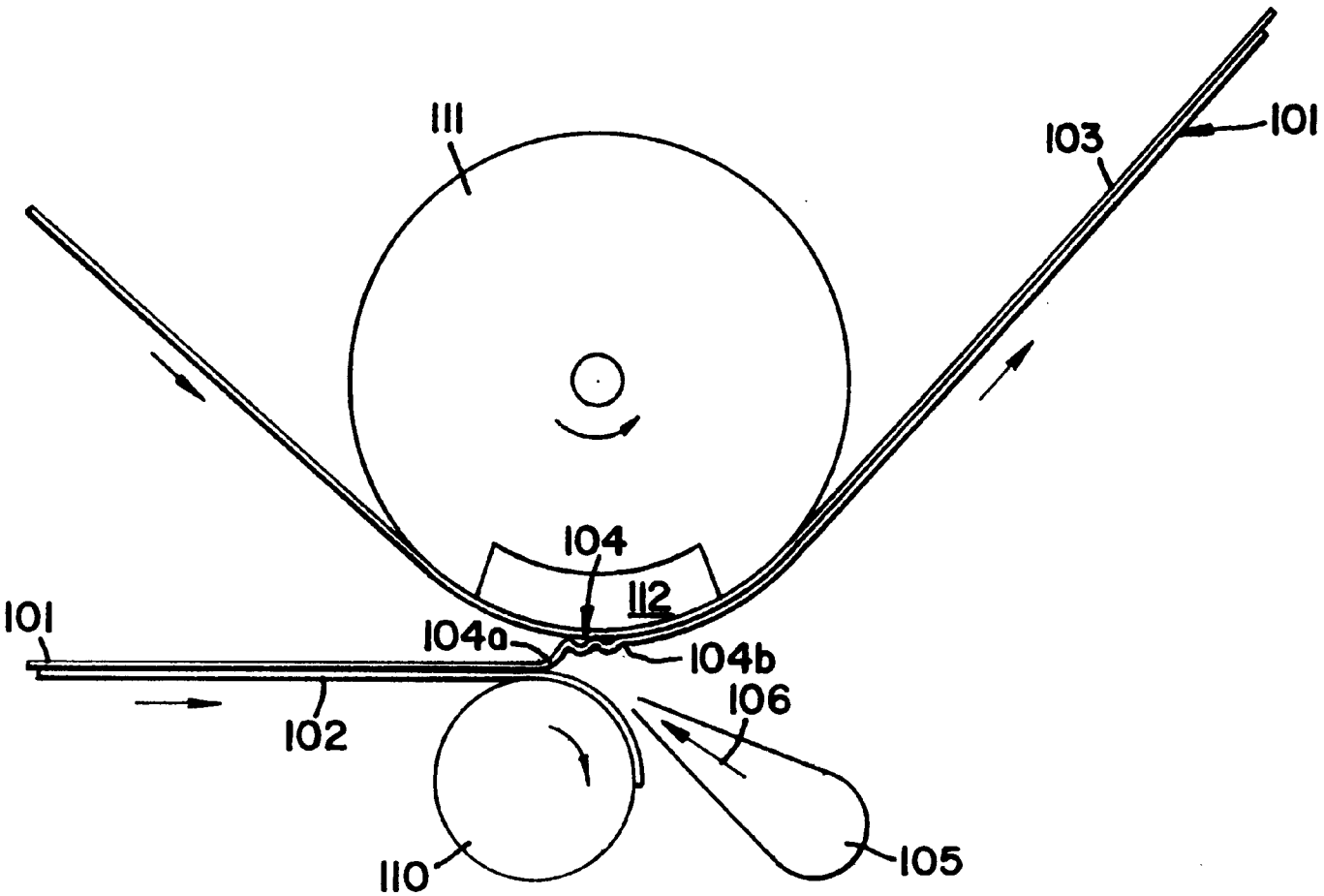

FIG. 2 shows a second embodiment of the differential velocity transfer apparatus of the invention using an air knife to promote transfer of the cellulosic web 101 from the first porous transport web 102 to the second porous transport web 103. In FIG. 1 the paper web 101 is transferred from a first transport porous web 102 to a second porous transport web 103 at a transfer region 104 between moving porous web 102 and moving porous web 103. The transfer region 104 includes the webs in close proximity, one to the other, however, the moving webs are not in contact. The transfer region 104 is defined by end points 104*a* and 104*b*. End point 104*a* comprises the point at which the cellulosic web 101 is separated from the first porous transfer web 102 and the opposite end point 104*b* defined by the point the cellulosic web becomes biased onto and adhered to the second porous transport web 103. The air knife stream 106 from air knife apparatus 105 is directed on the tangent lines at the interface between the cellulosic web and the moving porous web 102, which can help maintain the web in a plane prior to the deflection imparted by the air knife, thus improving or controlling the geometry of the transfer zone, where the angle of the first transport web into and out of the transfer zone can affect the properties imparted by the transfer. The air knife supports the traveling web as it passes through the transfer zone 104 from the first porous transport web 102 to the second web 103. In this embodiment, the air knife aids in removing the cellulosic web from the first moving porous web and supports the transfer web until it moves to the second. Similarly to FIG. 1, the first porous web 102 is driven by roller 110 while the second porous web is moved by roll 111. Roll 111 can optionally contain a vacuum device 112 that can aid in biasing the cellulosic web against and adhering the cellulosic web to the porous surface of the second transport web 103 using both the influence of the air knife stream 105 and the reduced pressure caused by the vacuum 112.

Figure 3:
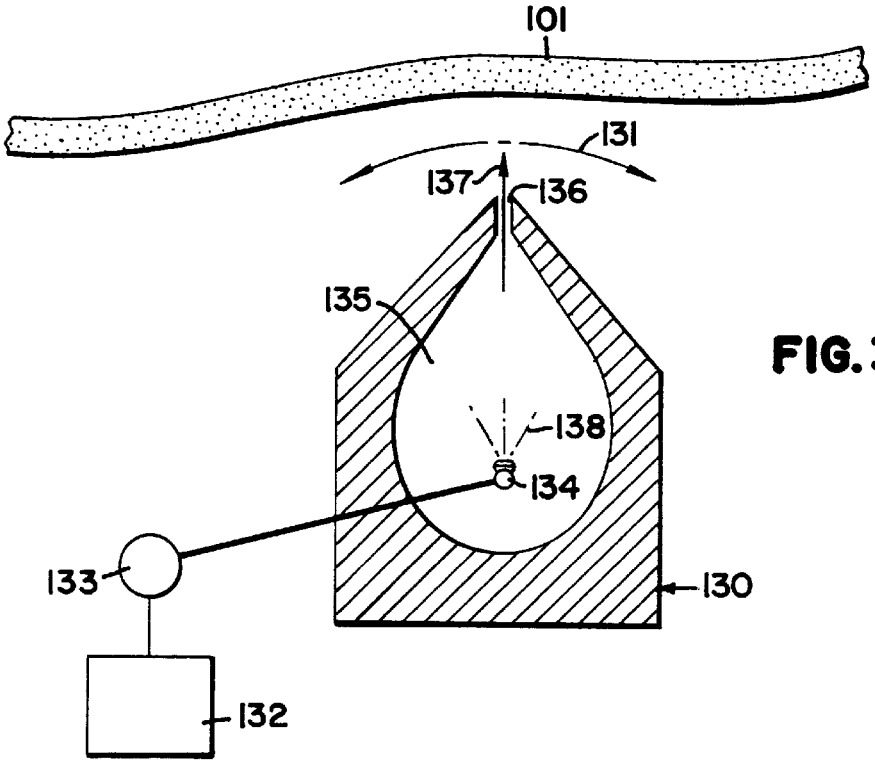
FIG. 3 shows an embodiment of an air knife having a chemical additive input that introduces the additive into the air stream directed at the paper web.

FIG. 3 is a cross-sectional view of one embodiment of the air knife device providing the air knife configuration of the invention with an entrained additive stream. FIG. 3 also shows apparatus 130 used to introduce the chemical additive 132 into the air knife stream 137. The stream of air 137 directed against the cellulosic web transfers the chemical additive 132 into and onto the cellulosic web 101. The air knife 130 is shown having an arc of travel 131. The arc of travel 131 aids in supporting the cellulosic web 101 and in transferring an even distribution of additive 132 to the cellulosic web 101. A source of chemical additive 132 driven by pump 133 directs additive 132 into the interior of the air knife into an atomization device 134. A source of ambient air under pressure (not shown) is directed into the interior of the air knife 135 and the pressurized air is directed as a result of the source of pressure from the elongated exit opening 136 of the air knife. In FIG. 3 the chemical additive is in the form of an aqueous solution, solvent based solution or mixed aqueous/solvent solution of the additive 132 in an aqueous medium. Pump 133 directs the aqueous solution to an atomizer 134 which entrains finely divided particles of chemical additive 138 into the air stream 137. The additive particles 138 are directed by air stream 137 against cellulosic web 101.

Figure 4:
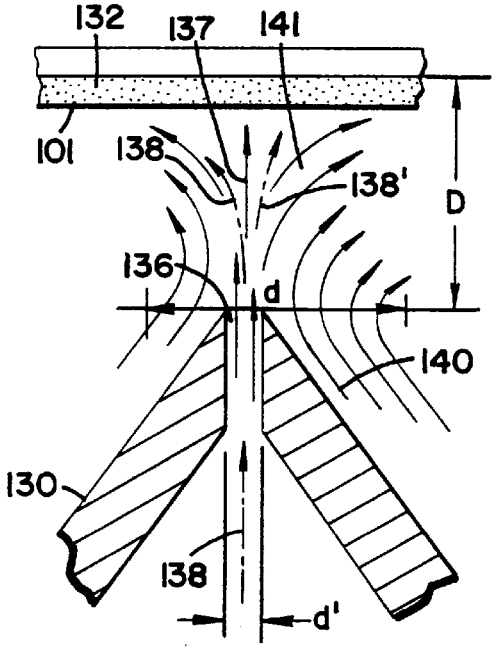
FIG. 4 shows detail of the air flow from the air knife and associated air flow around the air knife supporting the cellulosic web.

FIG. 4 is an illustration of air path from the air knife 137 of the invention against the cellulosic web 101. In FIG. 4, air knife apparatus 130 directs a stream of air knife 137 against the cellulosic web 101. The influence of the air stream 137 and the pressure differentials created by air stream 137 also brings against the cellulosic web 101, air 140 from the surrounding ambient atmosphere which is directed in a supporting mode 141 against the cellulosic web 101. The dimension D between the outlet of the air knife and the cellulosic web is about 0.3 to 15 centimeters, preferably about 0.5 to 5 centimeters (the transport web, not shown, can be imposed between the cellulosic web and the air stream). The width d' of the support stream comprising the air stream 137 is about 0.1 to 2 cm, preferably 0.2 to 1 cm. The width d of the influenced air stream 140 results from the overall geometry of the air knife, the amount of flow and speed of flow of the air stream 137 and the size and shape of the air knife structure 130. The width d is about 0.5 to 20 centimeters, preferably about 1 to 8 centimeters for efficient operations. Preferably, the pressure within the air knife apparatus is about 0.5 to 100 psi, specifically about 1 to about 20 psi and most specifically about 2 to about 10 psi. The air leaving the air knife is traveling at a speed of about 1 to 200 meters per second at the air knife exit orifice 136. The stream of chemical additive 138 is shown in the interior of the air knife apparatus 130. The dispersed streams of the chemical additive 138 and 138' are shown exiting the air knife opening 136 and is dispersed against the cellulosic web 101 resulting in a treatment layer of the chemical additive 132.

While the introduction of a chemical additive into the air stream can reduce air pressure and rate, the presence of typical amounts of chemical additive will not reduce the transport support role of the air stream. Sufficient amounts of chemical additive are added to the air stream to add typical treatment amounts of the chemical additive to the surface or interior of the cellulosic web. Typically such materials are added to the cellulosic web in amounts of about 0.1 to 10 grams per square meter, preferably about 0.3 to 3 grams per square meter. The dry add on levels of chemicals and particulates can be any useful level such as from about 0.1 to about 10 wt % relative to the dry fiber mass of the web, and more specifically can be from about 0.2 to about 5 wt %.

The above specification, examples and data provide a complete description of the manufacture and use of the processes of the invention. Since many embodiments of the invention can be made without departing from the spirit and scope of the invention, the invention resides in the claims hereinafter appended.

We claim:

1. A papermaking machine using a differentiated velocity transfer in the processing of a cellulosic web, the machine comprising:

(a) a cellulosic web, the cellulosic web supported on a first flexible transport web moved by a first roller at a first velocity, $V_1$;

(b) the cellulosic web also supported on a second flexible transport web, the second transport web proximate to but not in direct contact with the first transport web and spaced apart from the first transport web at a distance defining a transport zone for the cellulosic web, the second transport web moved by a second roller at a second velocity, $V_2$, wherein $V_2=kV_1$ and k is a factor of about 0.1 to about 0.98; and (c) a stream of a gas directed against the cellulosic web in the transport zone, the stream supporting the web during transfer from the first transport web to the second transport web.

2. The machine of claim 1 wherein the stream of gas is directed through the first transport web against the cellulosic web.

3. The machine of claim 2 wherein the direction of the gas stream is substantially normal to the cellulosic web.

4. The machine of claim 3 wherein the direction of the gas stream is substantially tangent to the surface of the first roller.

5. The machine of claim 1 wherein the gas stream is directed against the cellulosic web at the interface between the web and the first flexible transport web.

6. The machine of claim 1 wherein the first transport web and the second transport web are positioned in parallel motion and are spaced apart at a distance of about 0.3 to 15 cm in the transport zone.

7. The machine of claim 1 wherein the gas stream comprises a chemical and the chemical modifies a property of the web.

8. The machine of claim 7 wherein the chemical comprises an aqueous solution of the chemical.

9. The machine of claim 7, wherein the chemical is selected from the group consisting of a debonder, a softening agent, an emulsion, a wax, a silicone compound, and a sizing agent.

10. The machine of claim 1, wherein the cellulosic web comprises softwood fibers and has a basis weight between about 10 and 200 gsm.

11. The machine of claim 1 wherein the cellulosic web comprises about 40 to 80 wt.-% water.

12. The machine of claim 1 wherein k is about 0.2 to 0.8.

13. The machine of claim 1 wherein the gas comprises an ambient air stream comprising an air knife.

14. The machine of claim 13 wherein the temperature of the air stream is about 20° C. to about 50° C.

15. The machine of claim 1 further comprising a through-drier after the transport zone.

16. The machine of claim 1, wherein the cellulosic web is stratified.

17. A method of producing a tissue web, said method comprising:

(a) placing an embryonic paper web on a first flexible transport web traveling at a first velocity, $V_1$;

(b) transferring the embryonic paper web to a second flexible transport web traveling at a second velocity $V_2$, the first transport web being spaced apart from the second transport web at a minimum distance defining a transport zone, the distance being greater than the thickness of the embryonic paper web, wherein the transfer of the embryonic paper web is assisted by the action of a gaseous jet directed against the embryonic paper web, and wherein $V_2=kV_1$, and k is a factor of about 0.2 to about 0.9; and (c) drying the paper web.

18. The differential velocity web transport method of claim 17 further comprising a vacuum shoe adjacent the upper side of the second transport web to assist transport of the web across the web transport zone.

19. The differential velocity web transport method of claim 17 wherein the velocity of the gas exiting the air jet is at least 10 m/s.

20. The differential velocity web transport method of claim 17 wherein the air jet is in fluid communication with a pressurized gas source having a pressure of at least 10 psig.

21. The differential velocity web transport method of claim 17 wherein the gap is at least 1 cm.

22. The method of claim 17 wherein drying is substantially noncompressive.

23. The method of claim 17 wherein drying is done without creping the paper web.

24. A differential velocity web transport apparatus comprising:

(a) a first transport web having an upper surface and a lower surface for carrying a cellulosic web on the upper surface at a first velocity $V_1$;

(b) a second transport web having an upper surface and a lower surface for carrying a cellulosic web on the lower surface at a second velocity $V_2$, wherein $V_2=kV_1$, k being a factor between about 0.1 and 0.9; the second transport web approaching the first transport web in a web transport zone, the transport zone having a gap at the most proximate point between the first transport web and the second transport web of at least about 0.1 cm; and (c) an air knife disposed to displace the cellulosic web from the first transport web to the second transport web across the web transport zone.

25. The differential velocity web transport apparatus of claim 24 further comprising a vacuum shoe adjacent the upper side of the second transport web to assist transport of the web across the web transport zone.

26. The differential velocity web transport apparatus of claim 24 wherein the velocity of the gas exiting the air jet is at least 10 m/s.

27. The differential velocity web transport apparatus of claim 24 wherein the air jet is in fluid communication with a pressurized gas source having a pressure of at least 10 psig.

28. The differential velocity web transport apparatus of claim 24 wherein the gap is at least 1 cm.

29. The apparatus of claim 24, wherein the air knife is disposed on the lower side of the first transport web.

30. The apparatus of claim 24, wherein the air knife is disposed on the upper side of the first transport web.

31. The apparatus of claim 24, further comprising a chemical injector to add chemicals in the gas stream delivered by the air knife.

32. The apparatus of claim 31, wherein the chemical injector comprises an atomizer.

33. The apparatus of claim 31, wherein the chemical injector comprises a particulate dispersing apparatus.

34. The apparatus of claim 31, wherein the chemical injector introduces particles from a fluidized bed.

* * * * *